US005203473A

United States Patent [19]

Willey

[11] Patent Number: 5,203,473

[45] Date of Patent: Apr. 20, 1993

[54] TOOTHPASTE DISPENSER APPARATUS

[76] Inventor: Carlton B. Willey, P.O. Box 3471 3C02/203U, Corcoran, Calif. 93213-8310

[21] Appl. No.: 779,327

[22] Filed: Oct. 18, 1991

[51] Int. Cl.[5] ..... B65D 35/34

[52] U.S. Cl. ..... 222/94; 222/100; 222/181; 312/334.8

[58] Field of Search ..... 222/95-103, 222/181, 185, 187, 145; 248/108, 109; 403/80, 112, 109; 312/334, 335, 338

[56] References Cited

U.S. PATENT DOCUMENTS

| | | | |
|---|---|---|---|
| 764,777 | 7/1904 | Slater | 312/334 X |
| 879,690 | 2/1908 | Starrett | 312/335 |
| 1,221,643 | 4/1917 | Wood | 312/338 X |
| 1,453,121 | 4/1923 | Benner | 312/338 X |
| 2,605,932 | 8/1952 | Locke | 222/100 X |
| 2,822,111 | 2/1958 | Tripoli | 222/100 |
| 2,830,730 | 4/1958 | Saffir | 222/44 X |
| 3,917,118 | 11/1975 | Odgen | 222/100 |
| 4,010,871 | 3/1977 | Broadie | 222/100 X |
| 4,753,006 | 6/1988 | Howe | 222/96 X |
| 5,048,725 | 9/1991 | Peterson | 222/100 |

*Primary Examiner*—Andres Kashnikow
*Assistant Examiner*—Kenneth DeRosa
*Attorney, Agent, or Firm*—Leon Gilden

[57] ABSTRACT

A housing member includes a cap and floor mounted to opposed ends of the housing member, with the housing member including side walls to include spaced parallel slots to receive an axle member, wherein the axle member is formed with an axle member slot to receive a toothpaste tube end portion therewithin, wherein the axle member received within the opposed slots of the side walls effects expressing of toothpaste from the tube. The toothpaste tube is projected through a floor of the housing, with an adapter mounted fixedly to the toothpaste tube securing the toothpaste tube relative to the floor. A modification of the invention includes the axle formed with gear rack structure to positively project the axle downwardly along the slot structure, and may further include a modified adapter to permit imparting of a fluid to define a stripe on toothpaste directed through the adapter and its associated conduit.

1 Claim, 4 Drawing Sheets

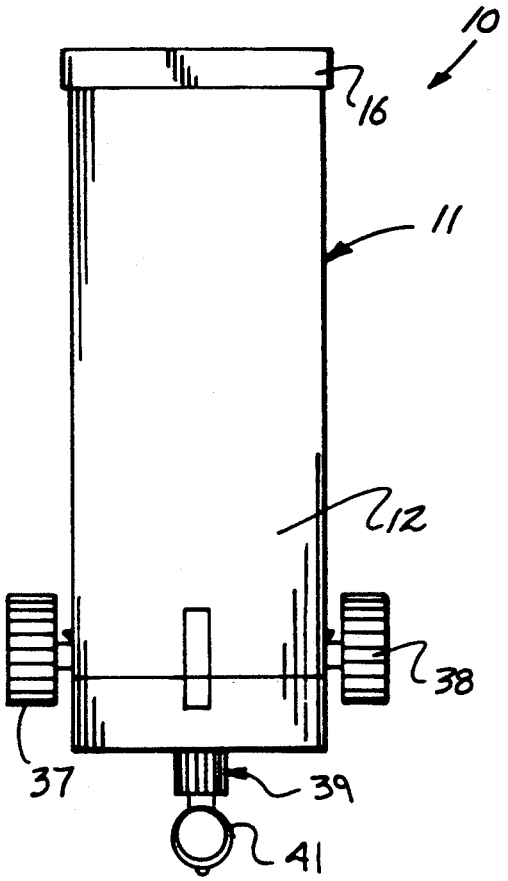
Fig 1
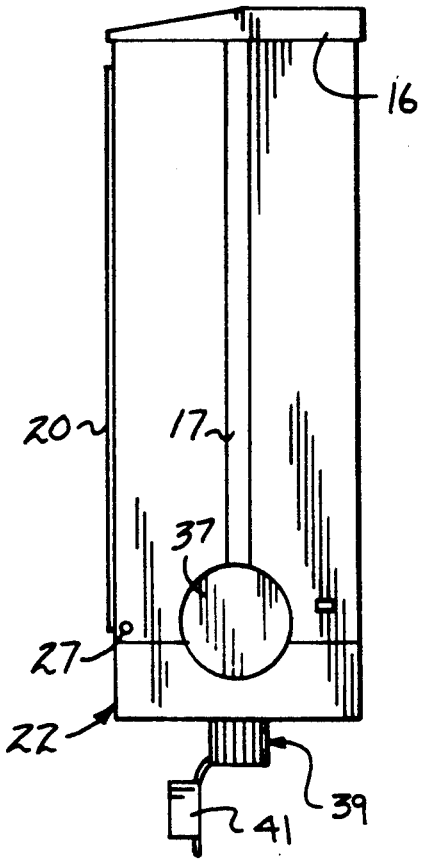
Fig 2
Fig 3
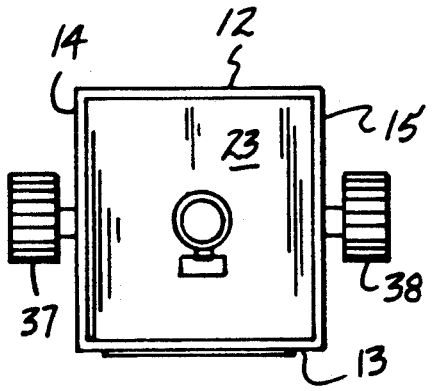
Fig 4
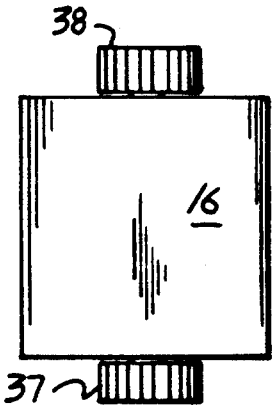

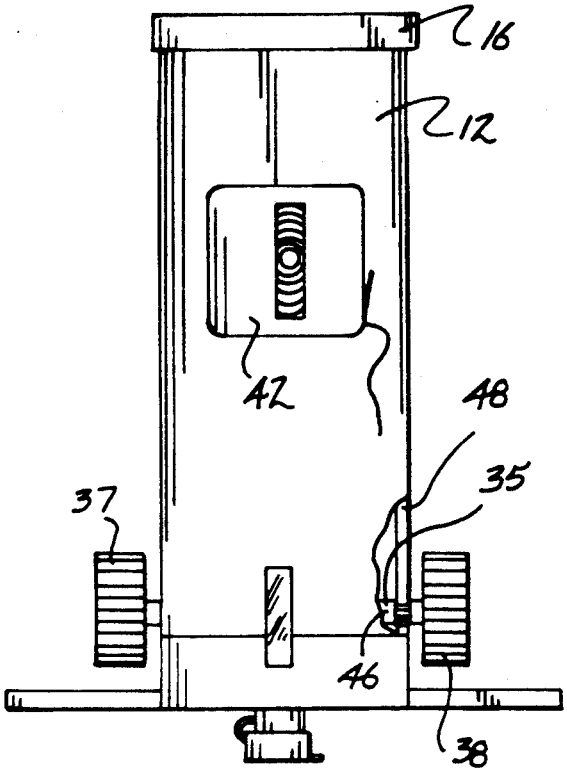
Fig 6
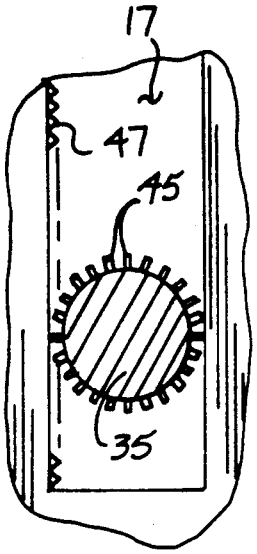
Fig 8
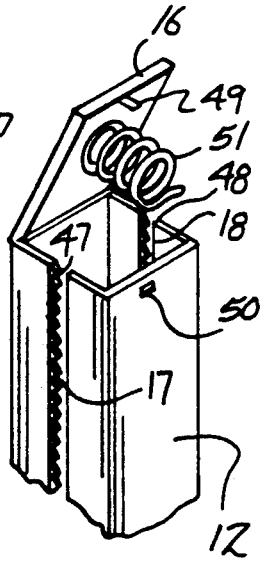
Fig 9
Fig 7
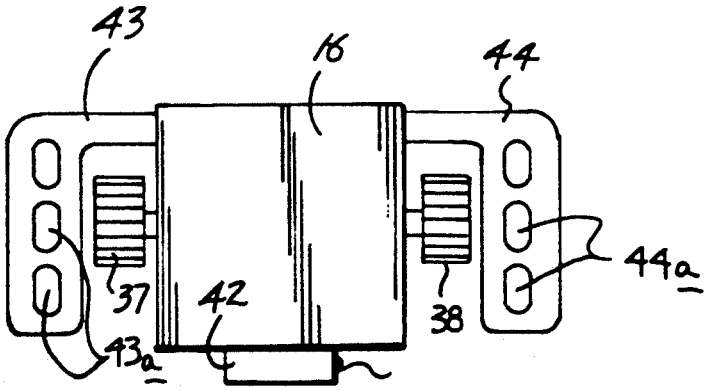

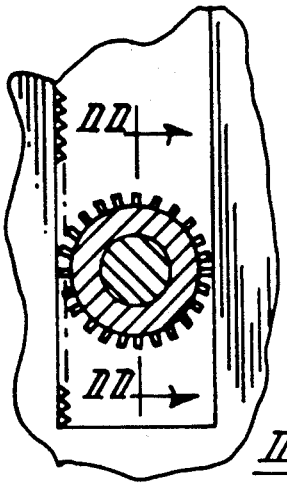
Fig 11
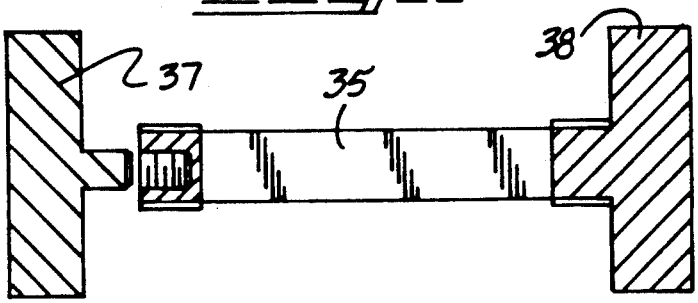
Fig 11
Fig 11
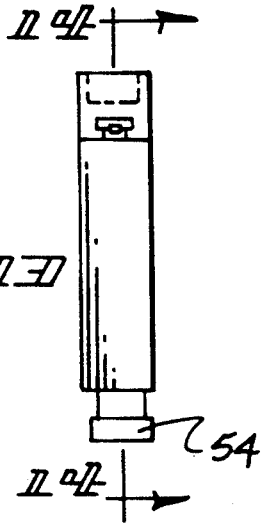
Fig 13
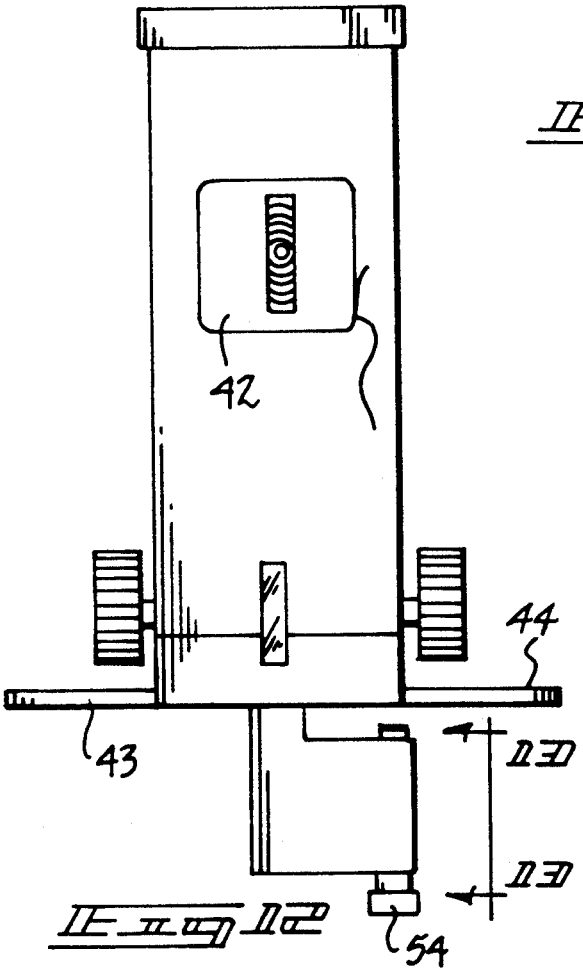
Fig 12
Fig 14
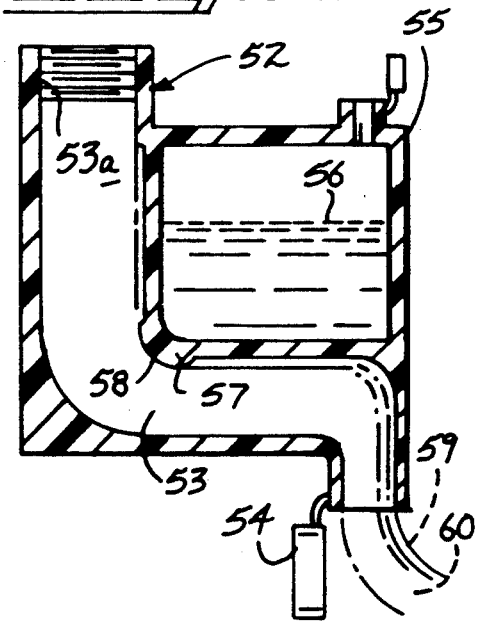

TOOTHPASTE DISPENSER APPARATUS

BACKGROUND OF THE INVENTION

1. Field of the Invention

The field of invention relates to toothpaste holder apparatus, and more particularly pertains to a new and improved toothpaste dispenser apparatus wherein the same is arranged for the selective expressing of toothpaste from a toothpaste tube in a sanitary and convenient manner.

2. Description of the Prior Art

Toothpaste dispensers of the prior art to manually empty and dispense toothpaste relative to a deformable tube are typically available, but have heretofore proven to be unsatisfactory in their containment and nature of expressing toothpaste. For example, U.S. Pat. No. 4,301,945 to Dworkin sets forth a toothpaste tube holder wherein the holder supports a toothpaste tube in a projecting relationship relative to the holder itself permitting unnecessary contact with the toothpaste tube once mounted to the holder structure.

U.S. Pat. No. 4,688,700 to Guthrie sets forth a dispenser for toothpaste utilizing a slotted axle to receive a toothpaste tube.

U.S. Pat. No. 3,954,205 to Williams sets forth a toothpaste dispenser, wherein the toothpaste dispenser mounts the toothpaste tube in a suspended orientation relative to the dispenser structure.

As such, it may be appreciated that there continues to be a need for a new and improved toothpaste dispenser apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toothpaste dispenser apparatus now present in the prior art, the present invention provides a toothpaste dispenser apparatus wherein the same is arranged for the selective and convenient expressing of toothpaste relative to a toothpaste tube holder. As such, the general purpose of the present invention, which will be described subsequently in greater detail, is to provide a new and improved toothpaste dispenser apparatus which has all the advantages of the prior art toothpaste dispenser apparatus and none of the disadvantages.

To attain this, the present invention provides a housing member including a cap and floor mounted to opposed ends of the housing member, with the housing member including side walls to include spaced parallel slots to receive an axle member, wherein the axle member is formed with an axle member slot to receive a toothpaste tube end portion therewithin, wherein the axle member received within the opposed slots of the side walls effects expressing of toothpaste from the tube. The toothpaste tube is projected through a floor of the housing, with an adapter mounted fixedly to the toothpaste tube securing the toothpaste tube relative to the floor. A modification of the invention includes the axle formed with gear rack structure to positively project the axle downwardly along the slot structure, and may further include a modified adapter to permit imparting of a fluid to define a stripe on toothpaste directed through the adapter and its associated conduit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothpaste dispenser apparatus which has all the advantages of the prior art toothpaste dispenser apparatus and none of the disadvantages.

It is another object of the present invention to provide a new and improved toothpaste dispenser apparatus which may be easily and efficiently manufactured and marketed.

It is a further object of the present invention to provide a new and improved toothpaste dispenser apparatus which is of a durable and reliable construction.

An even further object of the present invention is to provide a new and improved toothpaste dispenser apparatus which is susceptible of a low cost of manufacture with regard to both materials and labor, and which accordingly is then susceptible of low prices of sale to the consuming public, thereby making such toothpaste dispenser apparatus economically available to the buying public.

Still yet another object of the present invention is to provide a new and improved toothpaste dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic front view of the instant invention.

FIG. 2 is an orthographic side view of the instant invention.

FIG. 3 is an orthographic bottom view of the instant invention.

FIG. 4 is an orthographic top view of the instant invention.

FIG. 6 is an orthographic front view of a modified housing structure utilized by the invention.

FIG. 7 is an orthographic top view of the housing as set forth in FIG. 6.

FIG. 8 is an orthographic side view of the gear rack structure utilized by the toothpaste tube axle member.

FIG. 9 is an isometric illustration of a feed spring utilized by the invention.

FIG. 10 is an orthographic cross-sectional illustration of the assemblage of the toothpaste support axle member.

FIG. 11 is an orthographic view, taken along the lines 11—11 of FIG. 10 in the direction indicated by the arrows.

FIG. 12 is an orthographic front view of a further modified housing member of the invention utilizing a modified adapter mounted to a floor of the housing.

FIG. 13 is an orthographic view, taken along the lines 13—13 of FIG. 12 in the direction indicated by the arrows.

FIG. 14 is an orthographic view, taken along the lines 14—14 of FIG. 13 in the direction indicated by the arrows.

DESCRIPTION OF THE PREFERRED EMBODIMENT

Figure 5:
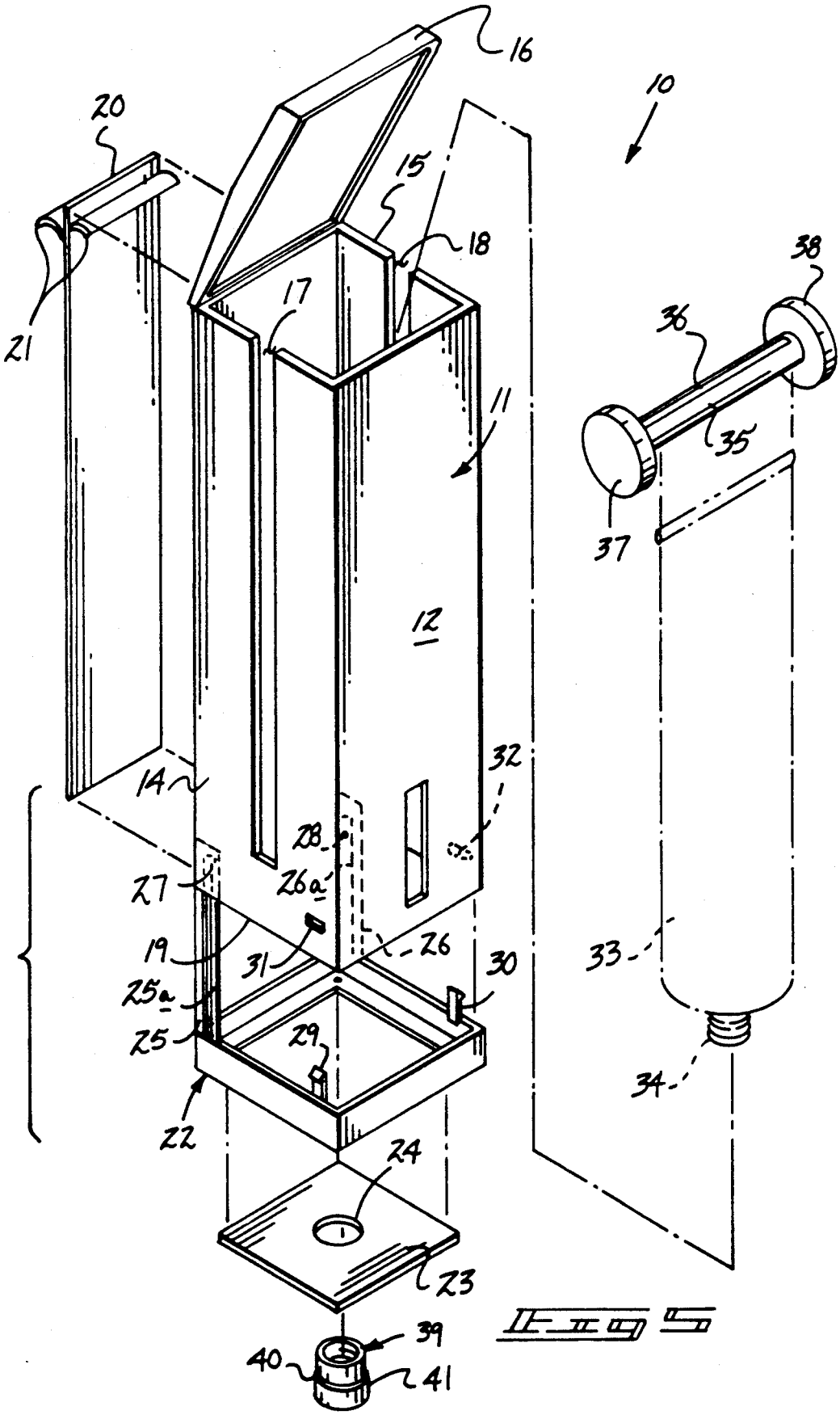
FIG. 5 is an isometric illustration of the instant invention in an exploded view for ease of illustration of the component parts thereof.

With reference now to the drawings, and in particular to FIGS. 1 to 14 thereof, a new and improved toothpaste dispenser apparatus embodying the principles and concepts of the present invention and generally designated by the reference numeral 10 will be described.

More specifically, the toothpaste dispenser apparatus 10 of the instant invention essentially comprises a housing 11 formed of a generally parallelepiped configuration, including a front wall 12 spaced from and coextensive with a rear wall 13. A housing first side wall 14 is spaced from and parallel a housing second side wall 15 spaced apart a predetermined spacing. The first side wall includes a first side wall slot and the second side wall includes a second side wall slot extending from an upper terminal end of each side wall downwardly thereof in a parallel relationship and spaced from the housing lower end 19. An adhesive web 20, including a peel-away cover strip structure 21, is arranged to permit adherence of the rear wall and the associated housing to a convenient support surface. A bottom end cap 22 is mounted to the housing 11 and more specifically, to the housing lower end 19, to include a floor 23 integrally contained within the cap 22 that in turn is formed with a floor opening 24 oriented medially of the floor 23 and configured of a predetermined diameter substantially equal to an external diameter defined by a toothpaste tube externally threaded nozzle 34 of an associated toothpaste tube 33. The nozzle 34, when directed through the opening 24, has thereafter secured thereto an internally threaded adapter boss 39 that in turn includes a lower end 40 arranged for securement of an adapter boss cap 41 thereon. As the boss 39 is of a width greater than the opening 24, a toothpaste tube 33 is oriented in a configuration relative to the floor 23.

The cap 22 includes a first slide 25 and a second slide 26 including a respective first slide groove **25*a* and a second slide 26*a* groove that are parallel relative to one another and are received slidably to interior surfaces of the first and second side walls, with a respective first and second pin 27 and 28 fixedly mounted to each side wall projecting through each respective first and second slide groove to maintain the bottom cap 22 in a mounted relationship relative to the housing lower end 19. First and second lock legs 29 and 30 mounted to the cap 22 are respectively received within first and second lock leg openings 31 and 32 directed through the respective first and second side walls to effect locking of the cap 22 relative to the housing 11**.

An axle member 35 includes an axle member slot 36 to receive the upper portion of the toothpaste tube 33 therethrough to effect a winding of the toothpaste tube to effect expressing of toothpaste therefrom. An axle member first boss 37 and an axle member second boss 38 are mounted to opposed distal ends of the axle member 35 and are positioned exteriorly of the respective first and second side walls 14 and 15.

Reference to FIGS. 6 and 7 illustrate the use of a dental floss dispenser housing 42 mounted to the front wall 12, with a first flange plate 43, including first flange plate openings **43*a* and a second flange plate 44, including second flange plate openings 44*a* arranged coplanar relative to one another and fixedly mounted to opposed sides of the cap 22** as the openings are arranged to receive associated handles of toothbrush members therethrough.

Reference to the FIGS. 6, 8, and 9 for example illustrate a modified axle structure 35 to include respective first and second gear teeth 45 and 46 spaced apart the predetermined spacing along the axle and cooperative with respective first and second tooth racks 47 and 48 mounted coextensively within the respective slots 17 and 18 to effect positive engagement with the axle 35 relative to the slots 17 and 18 in projecting the axle downwardly the slots to enhance compression of the toothpaste tube in expressing of toothpaste therefrom. The FIG. 9 illustrates the use of a spring member 51 mounted to an interior surface of the cap 16 medially thereof to impose pressure upon the axle 45 in maintaining the axle and the toothpaste in a downwardly biased relationship within the housing to enhance the proper positioning of the toothpaste tube 33 within the housing and accordingly, the cap 16 includes a housing cap lock leg 49 that is cooperative with the housing lock leg opening 50 directed through the front wall 12 to effect selective locking of the cap 16 relative to the housing.

FIGS. 10 and 11 illustrate the axle 35 and if desired, the use of the first and second boss members 37 and 38 threadedly received within opposed terminal ends of the housing for ease of removal of the axle subsequent to its use in the furling of a toothpaste tube thereabout.

FIGS. 12–14 illustrate the use of a modified adapter boss 52 that includes a conduit 53 directed therethrough in communication with the toothpaste tube externally threaded nozzle 34 secured to the conduit internally threaded upper terminal end portion 53*a* of the adapter boss 52. A conduit end cap 54 is selectively secured to a lower terminal end of the conduit 53. Further, a fluid reservoir 55 is mounted to the adapter boss 52 and may include a food coloring 56 and the like therewithin, wherein a reservoir outlet 57 in fluid communication with the conduit 53 directs such coloring through a porous mesh wick 58 to impart a stripe 59 onto an expressed toothpaste column 60 directed through the conduit 53 to enhance amusement for children in the regular use of toothpaste from the structure in promoting regular and proper dental care.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothpaste dispenser apparatus, comprising, a housing of a parellelepiped construction, including a front wall spaced from a rear wall, with a first side wall spaced from and parallel to a second side wall spaced apart a predetermined spacing, with a lid securable to an upper terminal end of the housing, and the housing defining a lower end, and a bottom end cap securable to the lower end, wherein the bottom end cap includes a cap floor, the cap floor including a floor opening directed medially of the cap floor to receive a toothpaste tube nozzle therethrough, and an adapter boss is securable to the toothpaste tube nozzle exteriorly of the housing, the adapter boss is securable to a toothpaste tube directed through the cap floor, with the adapter boss including an adapter boss conduit directed through the adapter boss, with a conduit end cap securable to a lower terminal end of the adapter boss conduit spaced from the floor, and the bottom end cap includes a first slide spaced from a second slide spaced apart the predetermined spacing, and wherein the first slide includes a first slide groove and the second slide includes a second slide groove, wherein the first slide and second slide are slidably mounted to the first side wall and the second side wall respectively, wherein the first side wall includes a first pin slidably received within the first slide groove, and the second side wall includes a second pin slidably received within the second groove, wherein the first pin and second pin are coaxially aligned relative to one another, and at least one lock leg mounted to the bottom end cap, wherein the at least one lock leg includes at least one lock leg opening directed through the housing to receive the lock leg for securement of the bottom end cap to the housing lower end, and the first side wall and the second side wall include respective first side wall slot and second side wall slot respectively, wherein the first side wall slot and the second side wall slot are arranged in a coextensive parallel relationship relative to one another, and wherein the first side wall slot is positioned medially of the first side wall and the second side wall slot is positioned medially of the second side wall, and an axle member defined by a predetermined length substantially equal to or greater than the predetermined spacing received within the first side wall slot and the second side wall slot, wherein the axle member includes an axle member slot to receive the toothpaste tube therethrough, and the first side wall slot includes a first tooth rack coextensive with the first side wall slot and the second side wall slot includes a second tooth rack coextensive with the second side wall slot, and the axle member includes a first rotary array of gear teeth spaced from a second rotary array of gear teeth the predetermined spacing, and wherein the first rotary array of gear teeth are engaged with the first tooth rack and the second rotary array of gear teeth are engaged with the second tooth rack and upon rotation of the axle member effects projection of the axle member downwardly along the first side wall slot and the second side wall slot, and the axle member includes a first boss and a second boss mounted to a respective first and second distal end of the axle member spaced exteriorly of the housing adjacent the respective first side wall and the second side wall, and the adapter boss includes a fluid reservoir, and further includes a fluid reservoir outlet in fluid communication with the adapter boss conduit, the reservoir outlet including a porous mesh wick to meter fluid from the fluid reservoir into the conduit.

* * * * *